428-408 SR
12/7/76 OR 3,996,408

United States Patent [19]
Fridman et al.

[11] 3,996,408
[45] Dec. 7, 1976

[54] CARBON-GRAPHITE BRUSHES FOR ELECTRIC MACHINES AND METHOD FOR MANUFACTURING SAME

[76] Inventors: Georgy Nikolaevich Fridman, Leninsky prospekt, 67, kv. 40; Jury Nikolaevich Vasiliev, ulitsa Vostrukhina, 6, korpus 3, kv. 67; Abram Samoilovich Fialkov, Kutuzovsky prospekt, 9, kv. 95; Yakov Gilievich Davidovich, Molodezhnaya ulitsa, 3, kv. 333; Abram Yakovlevich Gluskin, ulitsa Scherbakovskaya, 58, kv. 18, all of Moscow; Anatoly Alexandrovich Kozyrev, Sovetskaya ulitsa, 24, kv. 5, Elektrogorsk Moskovskoi oblasti; Roza Petrovna Batyreva, 1 Vladimirskaya ulitsa, 22, korpus 2, kv. 16; Evgeny Mikhailovich Kozlov, Armyansky pereulok, 9, kv. 59, both of Moscow; Anatoly Alexeevich Boiko, Komsomolskaya ulitsa, 7, kv. 38; Olga Borisovna Kazakova, ulitsa Sovetskaya, 5, kv. 25, both of Elektrougli Moskovskoi oblasti; Nadezhda Vasilievna Kalinina, Ketcherskaya ulitsa, 8, korpus 1, kv. 42, Moscow; Valentina Mikhailovna Emelyanova, 13 Parkovaya ulitsa, 20, korpus 3, kv. 62, Moscow; Igor Vyacheslavovich Yartsev, Zverinetskaya ulitsa, 6, kv. 16, Moscow, all of U.S.S.R.

[22] Filed: Feb. 28, 1975

[21] Appl. No.: 554,211

[52] U.S. Cl. ..... 428/408; 428/497; 428/500; 428/524; 428/539; 427/113; 427/114; 427/385 R; 310/252; 310/253; 252/511

[51] Int. Cl.[2] ..... H01R 39/24; H01R 39/26

[58] Field of Search ..... 427/114, 113, 385; 252/511; 310/251, 252, 253; 428/408, 497, 500, 524, 539

[56] References Cited

UNITED STATES PATENTS

| | | | |
|---|---|---|---|
| 2,224,724 | 12/1940 | Elsey | 427/114 |
| 2,393,816 | 1/1946 | Savage | 427/114 |
| 3,751,294 | 8/1973 | Fridman et al. | 427/114 |

FOREIGN PATENTS OR APPLICATIONS

| | | | |
|---|---|---|---|
| 638,418 | 3/1962 | Canada | 310/251 |
| 1,091,218 | 10/1960 | Germany | 427/114 |
| 266,034 | 2/1970 | U.S.S.R. | 310/252 |

OTHER PUBLICATIONS

Hawley, The Condensed Chemical Dictionary, Van Nostrand Reinhold Co., N.Y. (1971), p. 548.

*Primary Examiner*—Michael F. Esposito
*Attorney, Agent, or Firm*—Haseltine, Lake & Waters

[57] ABSTRACT

The present invention relates to heavy-current electrical engineering, and more particularly to carbon-graphite brushes characterized by high wear resistance and low adhesive capacity of the brush dust, said brushes being intended for operation in commutator machines under moderate or heavy commutation conditions at an operating temperature of the sliding contact from 200° to 250° C, and to a method for manufacturing same.

Carbon-graphite brushes for electric machines are made of a material which, after impregnation and heat treatment of the organic impregnation compound contains a dry residue evenly distributed through out the entire bulk volume thereof, the dry residue being a mixture of melamine-glyptal resin with a metal linoleate, in a polymerized state.

A method for manufacturing carbon-graphite brushes, wherein said brushes are impregnated with a compound based on melamine-glyptal resin and a metal linoleate dissolved in toluene or turpentine oil or any other solvent then heat treated at temperature ranging from 120° to 180° C till the impregnant is fully polymerized, the rated content of the dry residue in the brushes being to 0.5–10% by weight with respect to the initial weight of the brush material.

4 Claims, No Drawings

CARBON-GRAPHITE BRUSHES FOR ELECTRIC MACHINES AND METHOD FOR MANUFACTURING SAME

The present invention relates to heavy-current electrical engineering, and more particularly to carbon-graphite brushes for electric machines operating under moderate or heavy commutation conditions, and a method for manufacturing same.

Improving the properties of the electric brushes widely known in the art by their impregnation in various compounds is one of the current trends in perfecting commutator machines.

A great number of various impregnation compounds have been disclosed in patents filed in many countries, e.g. vegetable oil based compositions with various drying additives are widely known in varnish-and-paint industry.

Thus, C. C. Hardman has been granted a U.S. Pat. (No. 2,881,100 Apr. 7, 1959) for impregnation of carbon electrodes with a drying oil to protect said electrodes from disintegration, wherein the inventor applied a composite drier in the form of cobalt and lead naphthenate.

As far back as 1925, a patent (No. 407,987) was granted in Germany for protection of graphite and carbon rods from disintegration by way of impregnating them with soap based on burdock, linseed and coconut oil.

In 1967, a patent (No. 1,241,903) was also granted in the Federal Republic of Germany for impregnation of carbon brushes with unsaturated polyester resin.

And yet, linoleates with a high metal oxide content yield far better results than naphthenates and soaps.

The most recent patents for impregnation compounds for electric brushes with the use of a metal linoleate as one of the basic components, were granted for Soviet applications filed in France (No. 1,582,198 Aug. 18, 1969), Great Britain (No. 1,213,350 Nov. 25, 1970), the Federal Republic of Germany (No. 1,763,786 Jan. 13, 1972), and the USA (No. 3,751,294 Aug. 7, 1973).

However, cobalt linoleate, while enhancing the sliding contact properties of brushes, is not sufficiently heat-resistant, dries slowly when in a thick layer and has low cementing capacity.

It is an object of the present invention to provide carbon-graphite brushes for electric machines and a method for manufacturing same with a view to substantially improving the sliding contact properties of serially produced electric brushes by way of impregnating said brushes in a novel highly effective compound based an melamine-glyptal resin mixed with a metal linoleate, preferably cobalt linoleate.

This object is achieved by that in carbon-graphite brushes for electric machines, made of a material containing evenly distributed through out the entire volume thereof after impregnation and heat treatment of the organic impregnation compound, the dry residue is, according to the invention, a mixture of polymerized melamine-glyptal resin and a metal linoleate.

In manufacturing carbon-graphite electric brushes by impregnation thereof in varnishes and metal linoleates with subsequent heat treatment till the impregnation compound is fully polymerized, it is expedient to impregnate said brushes in a composite solution of melamine-glyptal resin and a metal linoleate.

Impregnation of said brushes in the above compound substantially improves the performances of the sliding contact pair reducing, at the same time the adhesiveness of the brush dust to electric insulation, thereby increasing the durability of the contact pair in particular and reliability of commutator machines in general.

As compared to cobalt linoleate, melamine, when added to the impregnation compound, substantially accelerates and improves its polymerization and provides for a higher mechanical strength of said brushes by increasing cementing capacity and eliminating the harmful effect of brushes on commutator segments, while glyptal resin which inhibits thermal destruction, considerably increases the heat resistance of the whole impregnation compound.

After the impregnation of brushes, the brush dust becomes much less adhesive to the insulation surfaces of a machine whereby the reliability of commutator machines is enhanced through.

High efficiency and simpliciy are another important feature of the proposed method for impregnating brushes in the novel compound.

Unlike conventional methods involving repeated impregnation with subsequent complex high-temperature heat treatment of brushes in vacuum or inert gases, the proposed one provides for only one impregnation cycle by immersion of brushes into the newly developed compound with subsequent short-term low-temperature heat treatment in an air oven.

Total expenditures involved in the proposed impregnation of brushes will do exceed an average of 10% of the total cost of said brushes, whereas the overall service life resistance of the brushes after impregnation increases 2–3 times, which renders serial production of which brushes highly economical.

The proposed method for impregnating brushes for electric machines can be easily reduced to practice and is rather advantageous economically, especially in large-series production.

For a better understanding of the present invention given below is an example of manufacturing brushes, which is merely illustrative and does not confine the scope of the present invention.

EXAMPLE

Finished carbon-graphite brushes or their blanks manufactured to size according to the drawings but without fixtures and connecting wires are dried, immediately prior to impregnation at a temperature of 100°–200° for 1–2 hours till fully dehumidified, then cooled down to a temperature of 60°–70° C and immersed into a bath or drawn into an autoclave at this temperature, the impregnation compound being diluted to the required viscosity.

The impregnation compound should preferably be prepared according to the following formulation:

one part of oleo-glyptal varnish containing 16% melamine resin;

four parts of cobalt linoleate containing up to 15% cobalt oxide

Solvent — turpentine oil or toluene.

The impregnation compound is diluted to the required viscosity at room temperature.

After immersion, brushes or blanks are kept in the solution for 1.5–2 hours at normal pressure. Then, they are with drawn, freed incrustations and dried under the following conditions (approximately):

| | |
|---|---|
| 1) in air | 3–5 hours |
| 2) at a temperature of 120° C | 2 hours |
| 3) at a temperature of 180° C | 4 hours |

Depending on the type and design of brushes, the weight of the dry residue of the impregnation compound after the heat treatment of the impregnated brushes may vary from 0.5 to 10% of the initial weight of the brushes or blanks, which is achieved by changing the working viscosity of the impregnation compound and adjusting the impregnation and heat treatment conditions.

TEST DATA

Given below by way of illustration are some typical results obtained after testing brushes, widely used in the USSR.

Table 1 shows the results of the tests to which the same sets of brushes were put before and after impregnation. The brushes were fitted in electric machines operating at temperatures of up to 150° C and under normal atmospheric conditions with a peripheral speed of 25 m/sec, the mean current density in the brushes being 10 A/cm$^2$.

Table 1

Comparative Data of Bench Tests of T-14 Brushes

| Nos. | Standard types of brushes | Performance data: Average wear speed (mm/100 hrs) | Performance data: Commutation (%) |
|---|---|---|---|
| 1. | Unimpregnated | 1.05 | 8 |
| 2. | Impregnated, with 4% dry residue content | 0.32 | 10 |
| 3. | As in 2, cut down to half the working height | 0.33 | 10 |
| 4. | As in 2, aged at 150° C for 4,000 hours | 0.35 | 9 |

Communication power was evaluated relative to the width of arcless zones according to Prof. V. T. Kasayanov method.

As can be seen from Table 1, impregnation of the test brushes has resulted in a slight improvement in commutation and a 3 times higher wear resistance, which value of wear resistance did not change noticeably even after said brushes had been artificially reduced in size to half the working length, and after ageing at a temperature of 150° C for 4,000 hours.

Table 2

| Nos. | Types of brushes | Performance data: Average wear speed (mm/100 hrs) | Resistance of machine Insulation (Megohm): Beginning of test | Resistance of machine Insulation (Megohm): After 2000 hrs |
|---|---|---|---|---|
| 1. | Unimpregnated | 0.5 | 50 | 3 |
| 2. | Impregnated, with 3.5% dry residue content | 0.27 | 50 | 25 |

Table 2 suggests that the test brushes impregnated according to the present invention are twice as wear-resistant as those which were not impregnated at all. After 2,000 hours of operation, the machines with impregnated brushes had a surface insulation resistance which was 8 times higher than that in machines with unimpregnated brushes.

What is claimed is:

1. A carbon-graphite brush impregnated with a coating consisting of 0.5 to 10% by weight per weight of brush of a composition containing a melamine-glyptal resin and a metal linoleate in a polymerized state, the composition resulting from one part of oleo-glyptal varnish containing about 16% melamine and 4 parts of metal linoleate containing up to 15% of metal oxide.

2. An impregnated carbon-graphite brush according to claim 1, wherein said metal linoleate is cobalt linoleate and said metal oxide is cobalt oxide.

3. A method for manufacturing a carbon-graphite brush impregnated with a coating consisting of 0.5 to 10% by weight per weight of brush of a composition containing a melamine-glyptal resin and a metal linoleate in a polymerized state, the composition resulting from one part of oleo-glyptal varnish containing about 16% melamine and 4 parts of metal linoleate containing up to 15% of metal oxide, which comprises treating said graphite brush with an impregnating solution composition of one part of oleo-glyptal varnish containing about 16% melamine resin and 4 parts of metal linoleate containing up to 15% metal oxide until said brushes are impregnated and heat treating the treated brushes until said impregnation composition is fully polymerized.

4. A method according to claim 3, wherein said metal linoleate is cobalt linoleate and said metal oxide is cobalt oxide.

* * * * *